United States Patent [19]

Rupp

[11] Patent Number: 5,050,809

[45] Date of Patent: Sep. 24, 1991

[54] FLAVORED SHAVED CUBE ICE MACHINE

[76] Inventor: Carl A. Rupp, 2382 S. Redwood Rd., Salt Lake City, Utah 84119

[21] Appl. No.: 503,760

[22] Filed: Mar. 23, 1990

[51] Int. Cl.[5] ..... B02C 19/12

[52] U.S. Cl. ..... 241/86.1; 99/484; 99/534; 99/537; 222/129.1; 241/88.1; 241/89.3; 241/95; 241/101.2; 241/DIG. 17

[58] Field of Search ..... 62/320; 99/537, 510, 99/534, 484, 516; 222/146.6, 410, 129.1, 129.2, 132, 133, 144.5; 241/101.2, 100, DIG. 17, 86.1, 88.1, 89.2, 89.3, 92, 94, 95; 118/15

[56] References Cited

U.S. PATENT DOCUMENTS

| | | | |
|---|---|---|---|
| Re. 9,383 | 9/1880 | Tompkins et al. | 241/89.3 |
| 3,001,189 | 9/1961 | Bert | 241/DIG. 17 X |
| 4,055,099 | 10/1977 | Mitsubayashi | 241/DIG. 17 X |
| 4,919,075 | 4/1990 | Himi | 241/DIG. 17 X |

*Primary Examiner*—Mark Rosenbaum
*Attorney, Agent, or Firm*—M. Reid Russell

[57] ABSTRACT

A flavored shaved cube ice machine that includes a cube ice shaver arranged within a cabinet. A shaving head, of the cube ice shaver is adjacent to receive cubes of ice from a bin and mounts a ring shaped blade wherein lateral slots are formed at intervals therealong that include outwardly projecting cutting edges. A wheel mounting paddle is journalled to be turned by an electric motor within the shaving head and is open to receive and move ice cubes feed from the bin against the ring-shaped blade that peels ice shavings from the individual cubes of ice and forces that shave ice through the slots and out through a discharge chute into a catchment vessel.

6 Claims, 2 Drawing Sheets

FLAVORED SHAVED CUBE ICE MACHINE

BACKGROUND OF THE INVENTION

1. Field of the Invention

This invention relates to machines for making shaved ice confectioneries. It is particularly concerned with providing a self-service type compact machine for use in stores, markets and the like.

2. Prior Art

Shaved ice particles have long been used in the manufacture of deserts and confectioneries. Commonly, such shavings are collected into a holder and a syrup of a desired flavor, or combination of flavors is poured over the ice to provide sweetening to a desired taste.

In the past, a great many devices have been proposed to provide the desired ice chips for ice shavings. Hand held and operated devices have been used for many years. Such devices generally comprise a holder for a knife blade that is drawn across a large block of ice or in some instances, larger, bulkier, devices have been used to crush the larger blocks of ice. More recently, machines have been proposed that will allow a large block of ice to be held in a fixed position while automatically operated cutter blades are pulled across a surface of that block of ice so as to produce ice shavings. The ice shavings are then collected and thereafter are scooped into a cone shaped container.

Blocks of ice are not always available, nor can they always be conveniently stored for a use like that of the present invention. As a result there is a need for a machine to make ice chips for shavings from smaller cubes such as are commonly produced not only by commercial type machines but even by common household refrigerators and freezer units.

U.S. Pat. Nos. 1,992,783, 2,565,226, 2,684,207 and 2,655,318, show machines that have been proposed for shaving cubes of ice. The disclosed machines provide for ice cubes to be placed in a hopper, feeding cubes of ice to blades that rotate beneath the pile of cubes of ice to shave ice as the blades rotate. The drive motors for the blades and all operating mechanisms of the machines, as well as the blades are beneath the ice and are therefore subject to serious damage from water as the ice melts, even though seals, intended to prevent such damage are provided.

SUMMARY OF THE INVENTION

Objects of the Invention

It is a principal object of the present invention to provide a compact machine for shaving cubed ice, dispensing the ice shavings into a receiver therefore, and selectively dispensing one or more confectionery syrups onto the ice shavings in that receiver.

Another object is to provide a cubed ice shaver that is easily and safely used, even by an unskilled person, which cubed ice shaver is relatively immune to damage from water from melting ice.

Still another object of the present invention is to provide a compact machine that is easily maintained and is reliable for use in a convenience store setting.

Features of the Invention

Principal features of the invention include a cabinet with a cube ice shaver therein. A bin is provided to receive cube ice from without the cabinet and to dispense the cube ice, by gravity feed, into the cube ice shaver. The cube ice is passed into a shaver head and therein is engaged by a shaver surface, that produces ice shavings that pass through the shaver surface to a discharge chute. Access to the bin is provided through a door in the cabinet located across the front of the cabinet top.

The discharge chute from the cube ice shaver is directed through the front wall of the cabinet for filling a receiver held under the chute end. Which cabinet front wall includes a sloped receiver base spaced beneath the end of the discharge chute to receive spilled syrup, ice shavings and water and to direct them to a drain hose.

A container rack is provided for fitting onto the top of the cabinet, adjacent to the bin door, to receive a number of syrup containers that are each connected by a flexible hose to an individual dispensing nozzle in a line of dispensing nozzles that are positioned adjacent to the discharge chute and above the receiver base.

Other objects and features of the invention will become apparent from the following detailed description and drawings disclosing what are presently contemplated as being the best modes of the invention.

THE DRAWINGS

DETAILED DESCRIPTION OF THE INVENTION

Figure 1:
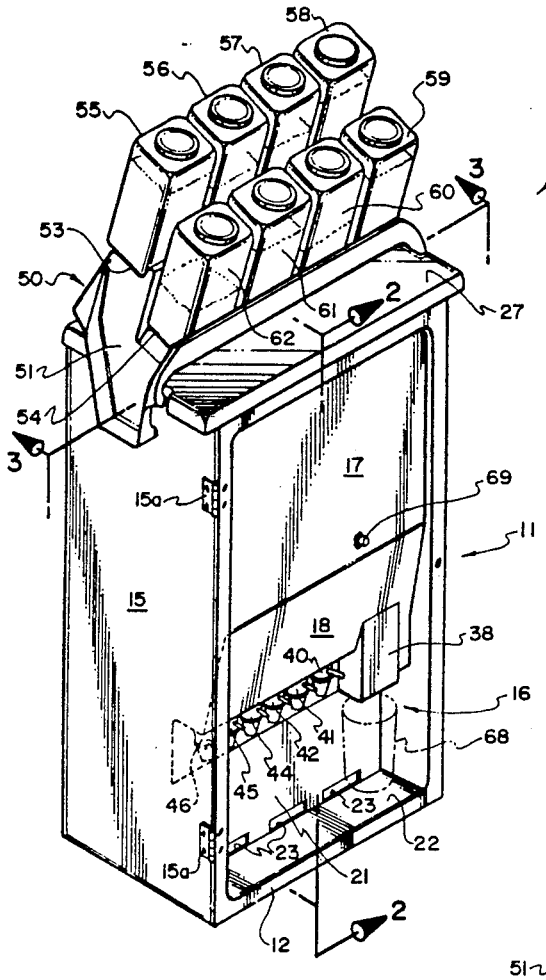
FIG. 1 is a perspective view, taken from slightly above and forward of a flavored shaved cube ice machine of the invention.

Referring now to the drawings:

In the illustrated preferred embodiment, the flavored shaved cube ice machine is shown generally at 10. As shown, the invention includes a cabinet 11 that has a bottom 12, a back 13, a fixed sidewall 14 and a pivoted sidewall 15, which sidewall is hinged at **15*a*** to serve as a door to provide access to the interior of the cabinet and components therein.

Figure 2:
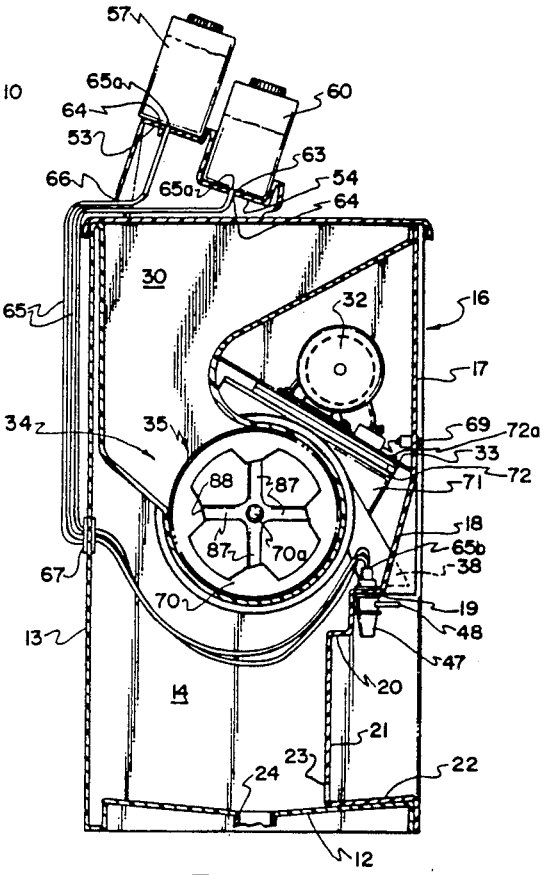
FIG. 2, is a vertical section view, taken along the line 2—2 of FIG. 1.

As shown best in FIG. 2, a cabinet front 16 includes the hinges **15*a* connected along one upright edge. A panel 17 is arranged as a section of cabinet front 16 that extends from the top edges of the sidewalls downwardly. Panel 17 is slanted inwardly at 18 into the cabinet and is bent at right angles to form double upper and lower ledges 19 and 20. The lower ledge 20 is then turned downwardly at a right angle to form a vertical panel 21 that is then bent at a right angle outwardly to form a drain-board 22. Which drain-board 22 is inclined slightly upperwardly to be fixed at its edge to a forward edge of the cabinet bottom 12. Shown in FIGS. 1 and 3, drain openings 23 are provided at the intersection of panel 21 and drain-board 22. Drain openings 23 allow liquids collected on that drain-board to flow into a drain opening 24, which drain opening 24 is centrally positioned in a lowermost portion of bottom 12, as shown best in FIGS. 2 and 3**.

Shown best in FIG. 1, a removable top 27 is provided that fits over the edges of the cabinet back 13, sidewalls 14 and 15 and front 16. Which removable top 27 can be raised to slide back and forth as necessary to allow for pouring of cubes of ice into and to cover a bin 30, that is shown best in FIGS. 2 and 3. The bin 30 is open to the top of the cabinet and is shaped to fit around a drive motor 32 and platform 33. Drive motor 32, as shown best in FIG. 2, is mounted onto platform 33 which platform is fixed to cabinet sidewall 14 and front 16 and to a bracket arranged across pivoted sidewall 15. The bin 30 is shaped such that ice cubes placed therein will fall and slide into a cube ice shaver 34, passing through a central open area of a wheel 70 and onto a blade 79 mounted in shaving head 35. The cube ice shaver 34, as set in more detail hereinbelow, includes and is powered by the drive motor 32, through a drive belt 36 and a pulley 37 that is fixed to and turns the wheel 70 that drags cubes of ice over blade 79.

A discharge chute 33 extends through the slanted wall portion 18 and terminates above the drain-board 22.

Shown best in FIG. 1, a plurality of aligned spaced nozzles 40 through 47 are each mounted to extend through the ledge 19, as shown in FIG. 2, arranged above the drain-board 22, and each nozzle 40 through 47 includes a valve therein that is operated by a lever 48.

Figure 3:
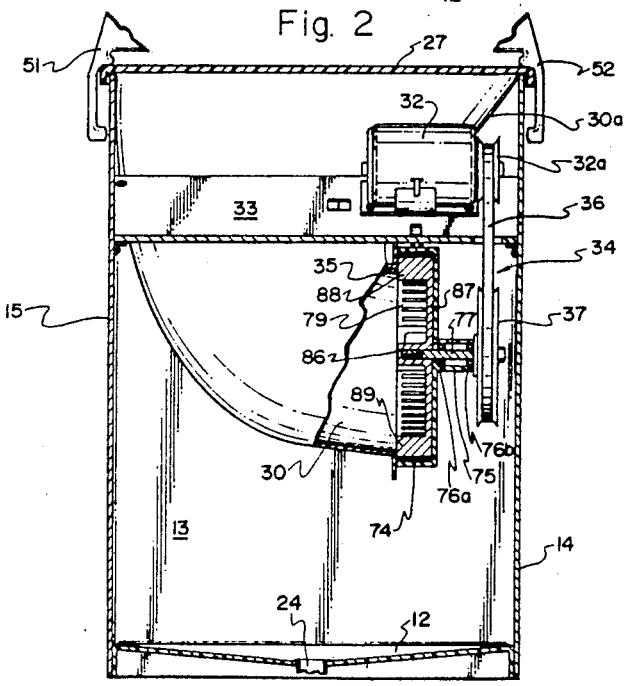
FIG. 3, is a similar transverse section view, taken along the line 3—3 of FIG. 2.

Shown in FIGS. 1, 2 and 3, is a rack 50 that includes legs 51 and 52 that are interconnected by an upper tray 53 and a lower tray 54. The rack 50 is mounted on the cabinet 11, to extend across the rear portion of the cabinet top 27. As shown, the legs 51 and 52 rest on the top cabinet 27 and syrup containers 55 through 62 are positioned alongside one another in the upper and lower trays. A hole 63 is provided through the bottom of each container 55 through 61, which hole aligns with a second hole 64 through each upper and lower tray 53 and 54. Individual flexible tubes 65 are each secured at their ends 65*a* in sealed arrangement in a syrup container hole and pass through the tray second hole 64. The flexible tubes 65 are bundled and pass through an opening 66 in rack 50 and back through a hole 67 formed in the container back 13. The flexible tubes 65, opposite ends 65*b* are each connected into the individual nozzles 40 through 47, to gravity feed syrup thereto.

Figure 4:
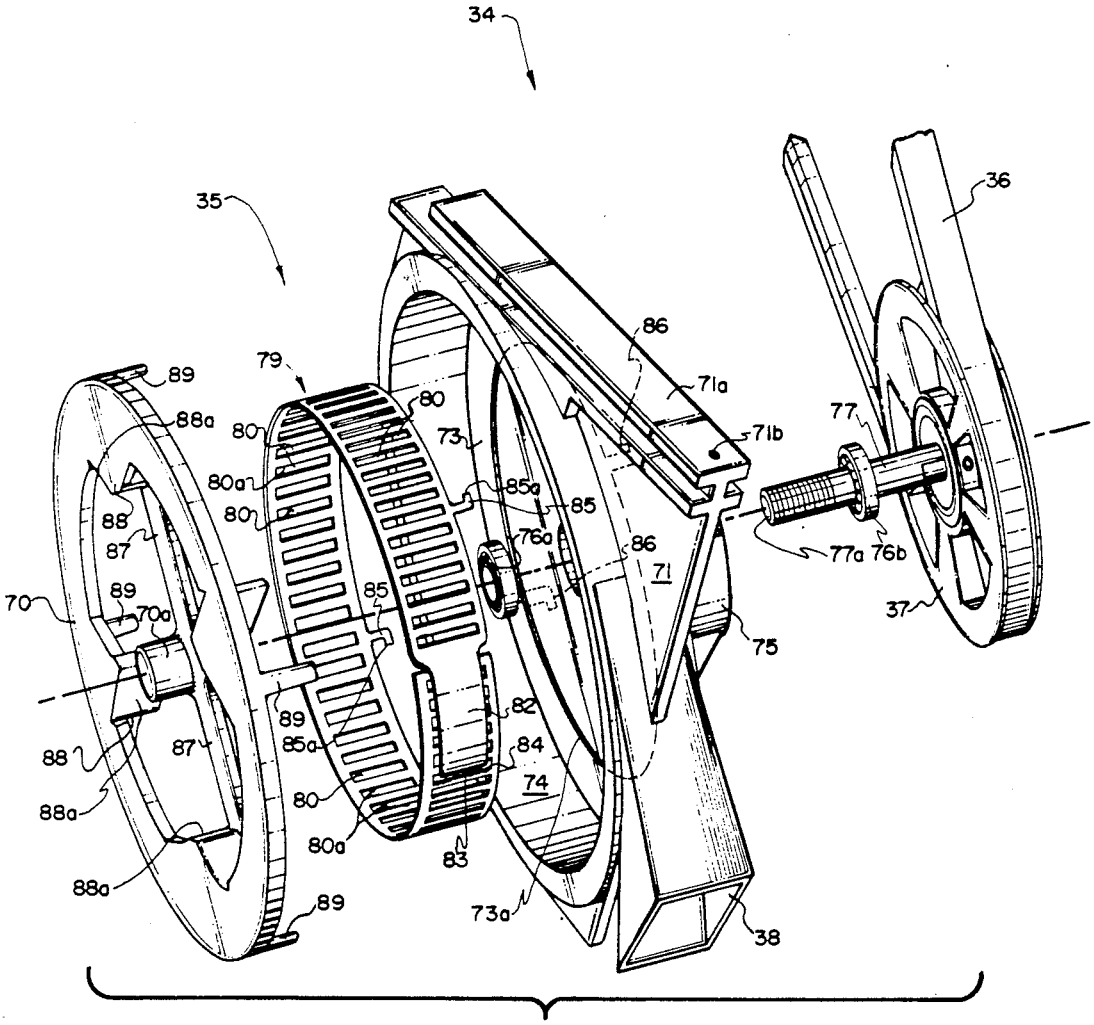
FIG. 4, is an exploded profile perspective view of a cube ice shaver section removed from the machine of FIGS. 1 through 3.

The cube ice shaver 34 includes the shaving head 35 consisting in part of a housing that, as shown FIGS. 2, 3 and 4, is supported to the undersurface of platform 33 at a guide member 71. Which guide member has an upper end 71*a* that is generally T-shaped in cross section to slide into a channel 72 secured to the undersurface of platform 33. A fastener, such as a bolt 72*a*, shown as a head end in FIG. 2 can be fitted through the platform 33 and turned into a threaded hole 71*b* formed in the top of the guide member upper end 71*a*, as shown best in FIG. 4, for securing that guide member to the platform 33. The shaving head 35 is preferably formed of aluminum and, as shown best in FIG. 4, includes a back wall 73 and a circular peripheral wall 74 with a circular groove 73*a* formed in that back wall 73. Shown in FIG. 3, a spider 75 projects from the back wall to support a bearing assembly that includes bearings 76*a* and 76*b*. A spindle 77 is fitted through that bearing assembly to journal it to the spider 75. The pulley 37 is fixed to one end of spindle 77, the V-belt 36 interconnecting that pulley 37 with a pulley 32*a* that is fixed to an output shaft of the drive motor 32. The drive motor 32 as set out above, is secured to the platform 33, and a control switch 69, as shown in FIG. 1, is mounted in the panel 17 for operation of motor 32 to dispense shaved ice through chute 38 into a cup 68.

As shown best in FIG. 4, the shaving head 35 receives a ring-shaped blade 79 mounted therein, above the circular peripheral wall 74, that has parallel slots 80 formed therein, extending at spaced intervals around and across the blade. The blade 79 is preferably made from a stainless steel band. With each slot 80 having a rear edge 80*a* that is projected slightly into the ring to serve as a shaving edge. Cubes of ice, as set out below, are urged against the blade 79 by the turning of wheel 70, the ice shavings passing therethrough to be moved by fingers 89 of wheel 70 traveling in circular groove 73*a* into the chute 30.

The ring-shaped blade 79 is formed into the ring by fitting a tab end 83 thereof, that is a solid section extending from the band edge, into a lateral slot 84 that is formed across the blade. Thereby the ring-shaped band 79 is secured into a ring for mounting adjacent to and just off of the shaving head back wall 73 and above the peripheral wall 74. The blade includes at least a pair of right angle tabs 85 that are spaced exidistantly apart, are planar, and each extends from the blade rear edge for aligning with and fitting through a slot 86 formed in the back wall 73. Each right angle tab is for fitting into the slot 86 in the back wall 73, whereafter, the blade 79 is turned so as to move toe ends 85*a* of each right angle tab 85, behind that back wall surface to lock the ring-shaped blade 79 to that shaving head 35.

The wheel 70, set out above, includes a hub 70*a* that is interiorly threaded with a left hand thread to be turned onto corresponding threads formed in the spindle end 77*a*. Which hub threads are of a depth to allow the wheel to be turned thereon to where arms 87, paddles 88 and fingers 89 of the wheel 70, are just above, and will pass without restriction, over the back wall 73, a side wall 74, and within circular groove 73*a*, respectfully. A plurality of arms 87 (here shown as four) radiate from the hub 70*a*, each of which connects to a paddle 88. The fingers 89, paddles 88, arms 87, hub 70*a* are preferably all cast or otherwise formed as integrally elements of the wheel 70.

Each paddle 88 has a forward surface 88*a* that is angled forwardly with respect to the direction of rotation of the wheel 70, and extends across the blade assembly. Each paddle surface 88*a* above the ring-shaped blade 79 serves to entrap ice cubes therebeneath and drag them over the ring-shaped blade 79, across the projected rear edges 80*a* of each parallel slot 80.

As ice cubes are dragged across the blade slot edges 80*a* particles are shaved therefrom and those shavings are forced through the slots 80 and against the back wall 73 and circular peripheral wall 74 of the shaving head 35. The finger 89 and wheel arms 87, work together scraping the ice particles from the walls and through creation of a wind generated by rotation of the paddles 89. The shaved particles are moved around the housing shaving head and propelled out through the discharge chute 38 that extends substantially tangentially downwardly from a top of the shaving head 35.

In practice, a user positions a cup 68 (or other receiver) beneath the discharge chute 38 and pushes button 69, mounted in the panel 17. Button 69 operates motor 32 to shave, as set out above, ice from cubes placed in bin 30 and to discharge the shaved ice into the cup. After the cup is filled it is moved beneath one or more of the nozzles 40 through 47 which are then manually operated by depressing their individual lever 48 to allow syrup to flow from that nozzle over the shaved ice in the cup.

Although a preferred form of my invention has been herein disclosed, it is to be understood that the present disclosure is by way of example and that variations are possible without departing from the subject matter coming within the scope of the following claims and a reasonable equivalency thereof, which subject matter I regard as my invention.

I claim:

1. A cube ice shaving machine comprising, a cabinet; a cube ice shaver arranged in said cabinet, and said cube ice shaver includes a shaving head consisting of: a housing, a spindle, with a plurality of paddles mounted on said spindle for rotation therewith, a ring-shaped blade assembly closely surrounding said paddles, said blade assembly having lateral slots spaced at intervals therearound, each with an outwardly projecting rear edge as an ice shaving means, and means to axially rotate said spindle; means to direct ice cubes into said cabinet; means within said cabinet for containing and directing ice cubes into said cube ice shaver the cube of ice traveling between said paddles and blade assembly; means to direct ice shavings formed by movement of ice cubes over said blade assembly out of the cabinet for capture in a vessel; and means for containing and dispensing syrup on demand into a vessel containing ice shavings.

2. A cube ice shaver machine as in claim 1, wherein the means to axially rotate the spindle comprises a first pulley that is mounted on an end of the spindle; a motor having an output shaft with a second pulley that is fixed to said output shaft; and a drive belt interconnecting said first and second pulleys.

3. A cube ice shaver as in claim 1, wherein the means to direct ice cubes into the cabinet comprises a feed hopper that extends through a top of the cabinet.

4. A cube ice shaver as in claim 1, wherein the means within the cabinet for containing and directing cubes of ice into the cube ice shaver comprises, a bin having downwardly and inwardly inclined surfaces.

5. A cube ice shaver as in claim 1, wherein the means to direct ice shavings out of the cabinet comprises, a discharge chute that extends essentially tangentially downwardly from the cube ice shaver, adjacent to an upper portion of the shaving head.

6. A cube ice shaver as in claim 1, wherein the means for containing and dispensing syrup includes a shelf for arrangement across a portion of the cabinet top; a plurality of bottles for arrangement on said shelf, each bottle openable to receive syrup therein and each bottle includes a bottom opening; a flexible tube for each bottle where one tube end is sealed in said bottle bottom opening and the other tube end is connected to a valve means on a front portion of the cabinet; and a manually operated valve means arranged with each flexible tube other end, said manually operated valve means for dispensing syrup that is gravity fed thereto from an individual bottle.

* * * * *